US008858363B2

(12) United States Patent
Wada et al.

(10) Patent No.: US 8,858,363 B2
(45) Date of Patent: Oct. 14, 2014

(54) GOLF CLUB HEAD

(71) Applicant: Bridgestone Sports Co., Ltd., Tokyo (JP)

(72) Inventors: Kozue Wada, Minato-ku (JP); Wataru Ban, Minato-ku (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 13/827,306

(22) Filed: Mar. 14, 2013

(65) Prior Publication Data

US 2013/0324298 A1 Dec. 5, 2013

(30) Foreign Application Priority Data

Jun. 5, 2012 (JP) ..... 2012-128347

(51) Int. Cl.
*A63B 53/04* (2006.01)
*A63B 53/06* (2006.01)
*A63B 59/00* (2006.01)

(52) U.S. Cl.
CPC ..... *A63B 53/06* (2013.01); *A63B 53/0466* (2013.01); *A63B 59/0092* (2013.01); *A63B 2053/0433* (2013.01); *A63B 2059/0003* (2013.01); *A63B 2053/045* (2013.03); *A63B 2053/0408* (2013.01); *A63B 2053/0491* (2013.01); *A63B 2053/0437* (2013.01)
USPC ..... 473/346; 345/344; 345/335; 345/334; 345/332

(58) Field of Classification Search
CPC ..... A63B 2053/045; A63B 2053/0433; A63B 2053/0491; A63B 59/0092
USPC ..... 473/346, 344, 335, 334, 332, 345
See application file for complete search history.

(56) References Cited

U.S. PATENT DOCUMENTS

| | | | | |
|---|---|---|---|---|
| 5,316,298 | A | 5/1994 | Hutin et al. | |
| 5,409,229 | A | 4/1995 | Schmidt et al. | |
| 5,570,886 | A | 11/1996 | Rigal et al. | |
| 5,605,511 | A | 2/1997 | Schmidt et al. | |
| 5,842,934 | A | 12/1998 | Ezaki et al. | |
| 7,125,343 | B2 | 10/2006 | Imamoto | |
| 7,232,381 | B2 | 6/2007 | Imamoto | |
| 7,273,423 | B2 | 9/2007 | Imamoto | |
| 7,344,452 | B2 | 3/2008 | Imamoto et al. | |
| 7,410,427 | B2 | 8/2008 | Imamoto et al. | |
| 7,455,600 | B2 | 11/2008 | Imamoto et al. | |
| 7,637,823 | B2 * | 12/2009 | Shimazaki et al. | 473/332 |
| 7,749,101 | B2 | 7/2010 | Imamoto et al. | |
| 7,806,781 | B2 * | 10/2010 | Imamoto | 473/332 |

FOREIGN PATENT DOCUMENTS

| | | | |
|---|---|---|---|
| JP | 60-116369 | U | 8/1985 |
| JP | 6-510689 | A | 12/1994 |
| JP | 7-501472 | A | 2/1995 |
| JP | 7-148291 | A | 6/1995 |

(Continued)

*Primary Examiner* — Benjamin Layno
(74) *Attorney, Agent, or Firm* — Sughrue Mion, PLLC

(57) ABSTRACT

This invention provides a hollow golf club head including a face portion, a crown portion, a sole/side portion which includes a sole portion and a side portion, and a weight member. The golf club head includes a recessed portion which is formed in the sole/side portion, and has an outer surface to which the weight member is attached, and a rib which is formed on the inner surface of the sole/side portion, and traverses the recessed portion across the peripheral edge defining the recessed portion.

10 Claims, 5 Drawing Sheets

(56) References Cited

FOREIGN PATENT DOCUMENTS

| | | | |
|---|---|---|---|
| JP | 9-285578 | A | 11/1997 |
| JP | 10-263114 | A | 10/1998 |
| JP | 2000-93564 | A | 4/2000 |
| JP | 2000-107334 | A | 4/2000 |
| JP | 2002-186691 | A | 7/2002 |
| JP | 2003-102877 | A | 4/2003 |
| JP | 2005-6835 | A | 1/2005 |
| JP | 2005-21649 | A | 1/2005 |
| JP | 2005-160947 | A | 6/2005 |
| JP | 2005-160948 | A | 6/2005 |
| JP | 2006-130065 | A | 5/2006 |
| JP | 2007-83012 | A | 4/2007 |
| JP | 2010-234108 | A | 10/2010 |
| JP | 2011-5166 | A | 1/2011 |

* cited by examiner

GOLF CLUB HEAD

BACKGROUND OF THE INVENTION

1. Field of the Invention

The present invention relates to a golf club head and, more particularly, to a technique of improving an impact sound.

2. Description of the Related Art

In hollow golf club heads typified by a driver head, the head volume is increasing each year, so the crown and sole portions are getting thinner, and their areas are increasing along with this trend. Under the circumstance, a low-pitched impact sound is more likely to be generated at the time of striking a golf ball, so golfers who prefer high-pitched impact sounds want golf club heads which generate higher-pitched impact sounds. Hence, Japanese Patent Laid-Open Nos. 2002-186691 and 2003-102877, for example, disclose techniques of improving an impact sound by providing a rib in the sole portion.

On the other hand, as the head volume increases, the barycentric position easily shifts to the toe side. Hence, Japanese Patent Laid-Open Nos. 2010-234108 and 2011-5166, for example, disclose techniques of adjusting the barycentric position by providing a weight member. These patent literatures also disclose techniques of providing a rib to improve the strength of the periphery of the weight member.

When a weight member for barycentric position adjustment is provided, the eigenvalue of the first-order vibration mode of a golf club head changes. This means that the impact sound generated at the time of striking a golf ball changes. It is a common practice to determine the specifications of a weight member in the final stage of manufacturing a product, and design a golf club head in consideration of an impact sound before the specifications of the weight member are determined. Therefore, it is often impossible to obtain a target high-pitched sound as the impact sound considerably changes as a result of providing a weight member.

SUMMARY OF THE INVENTION

It is an object of the present invention to provide a golf club head which generates a higher-pitched sound even when a weight member is provided.

According to the present invention, there is provided a hollow golf club head including a face portion, a crown portion, a sole/side portion which includes a sole portion and a side portion, and a weight member, the head comprising: a recessed portion which is formed in the sole/side portion, and has an outer surface to which the weight member is attached; and a rib which is formed on an inner surface of the sole/side portion, and traverses the recessed portion across a peripheral edge defining the recessed portion.

Further features of the present invention will become apparent from the following description of exemplary embodiments with reference to the attached drawings.

DESCRIPTION OF THE EMBODIMENTS

Figure 1:
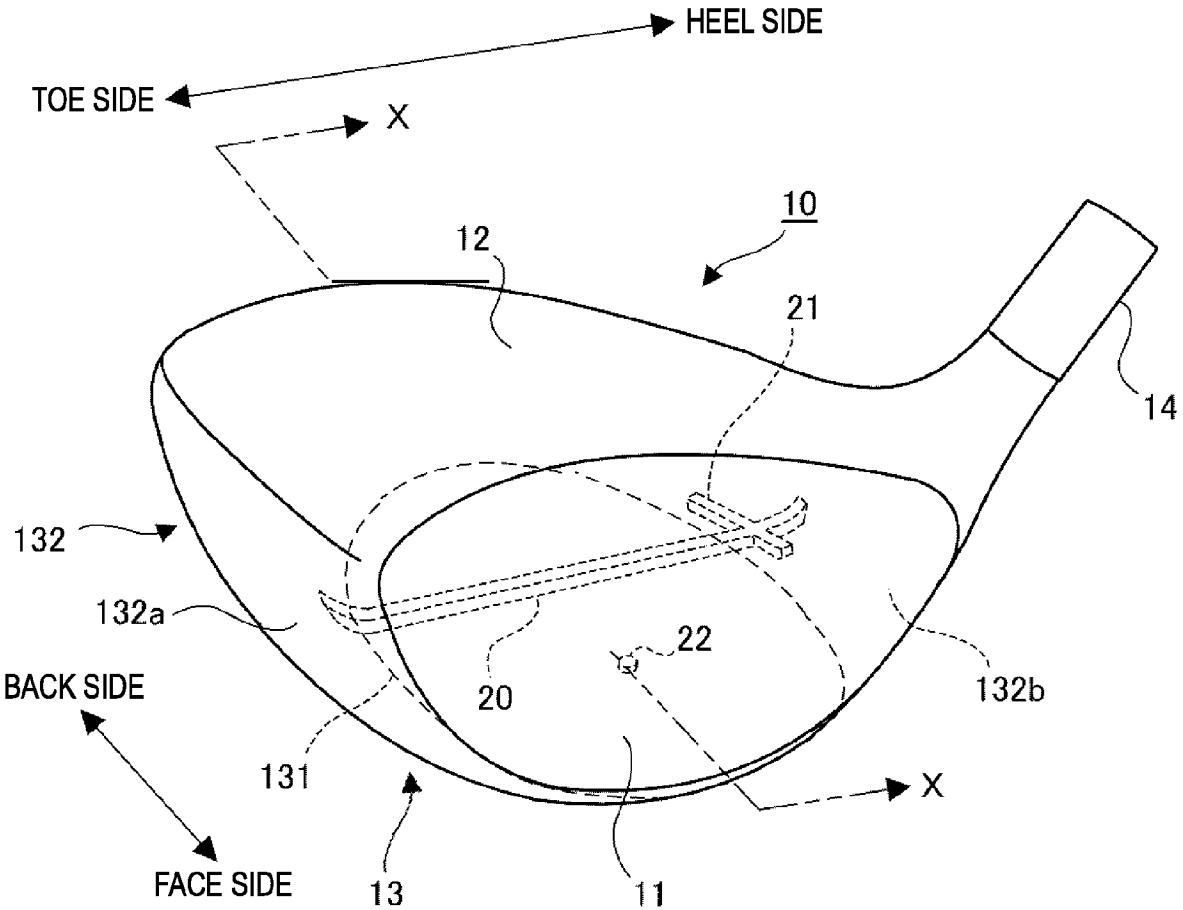
FIG. 1 is a perspective view of a golf club head according to an embodiment of the present invention.
Figure 2A:
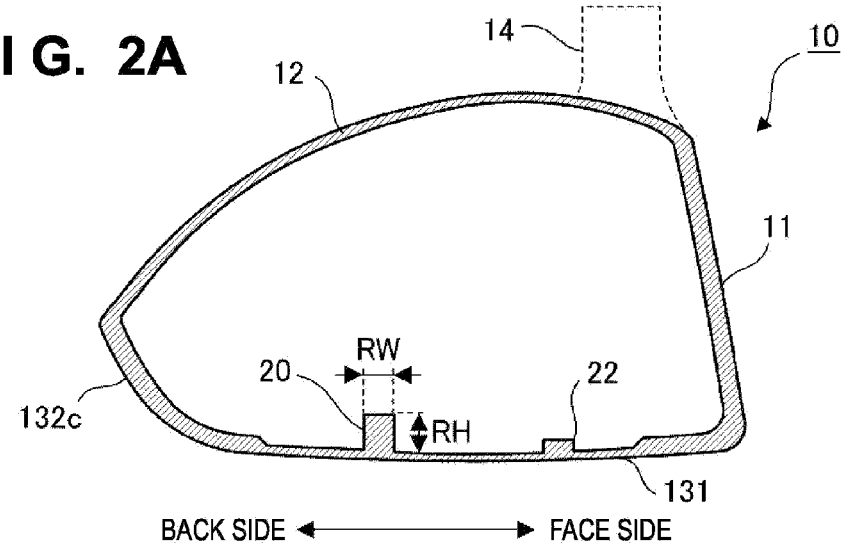
FIG. 2A is a sectional end elevational view taken along a line X-X in FIG. 1.
Figure 2B:
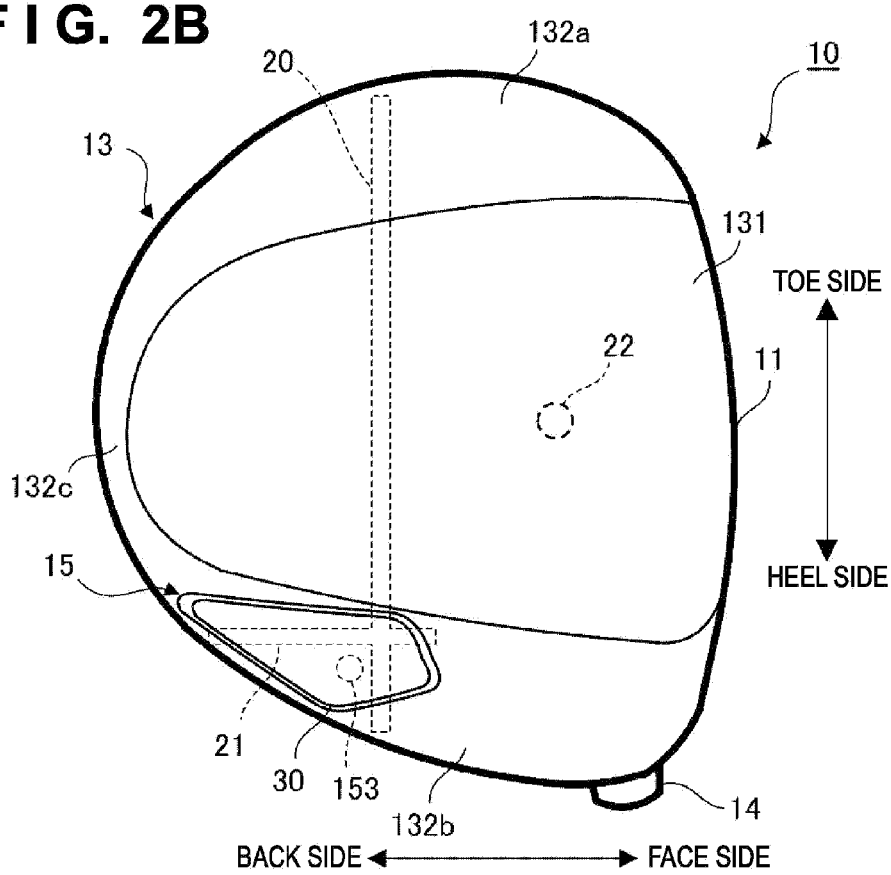
FIG. 2B is a bottom view of the golf club head shown in FIG. 1.

FIG. 1 is a perspective view of a golf club head 10 according to an embodiment of the present invention when ribs 20 and 21 and weight portion 22 disposed inside it are seen through, FIG. 2A is a sectional view taken along a line X-X in FIG. 1, and FIG. 2B is a view of the golf club head 10 as viewed from the side of a sole portion 131.

The golf club head 10 has a hollow body, and its peripheral wall constitutes a face portion 11 forming a face surface (striking surface), a crown portion 12 forming the upper portion of the golf club head 10, and a sole/side portion 13. The sole/side portion 13 constitutes the sole portion 131 forming the bottom portion of the golf club head 10, and a side portion 132 between the crown portion 12 and the sole portion 131. The side portion 132 forms the side portion of the golf club head 10, and includes a toe-side side portion 132*a*, heel-side side portion 132*b*, and back-side side portion 132*c*. The golf club head 10 also includes a hosel portion 14 to which a shaft is attached.

The golf club head 10 is a driver golf club head. However, the present invention is applicable to wood golf club heads including not only a driver golf club head but also, for example, a fairway wood golf club head, utility (hybrid) golf club heads, and other hollow golf club heads. The golf club head 10 can be made of a metal material such as a titanium-based metal (for example, 6Al-4V—Ti titanium alloy), stainless steel, or a copper alloy such as beryllium copper.

The golf club head 10 can be assembled by bonding a plurality of parts. The golf club head 10 can be formed by, for example, a main body member and a face member. The main body member forms the peripheral portions of the crown portion 12, sole portion 131, side portion 132, and face portion 11, and has an opening partially formed in a portion corresponding to the face portion 11. The face member is bonded to the opening in the main body member.

Figure 3:
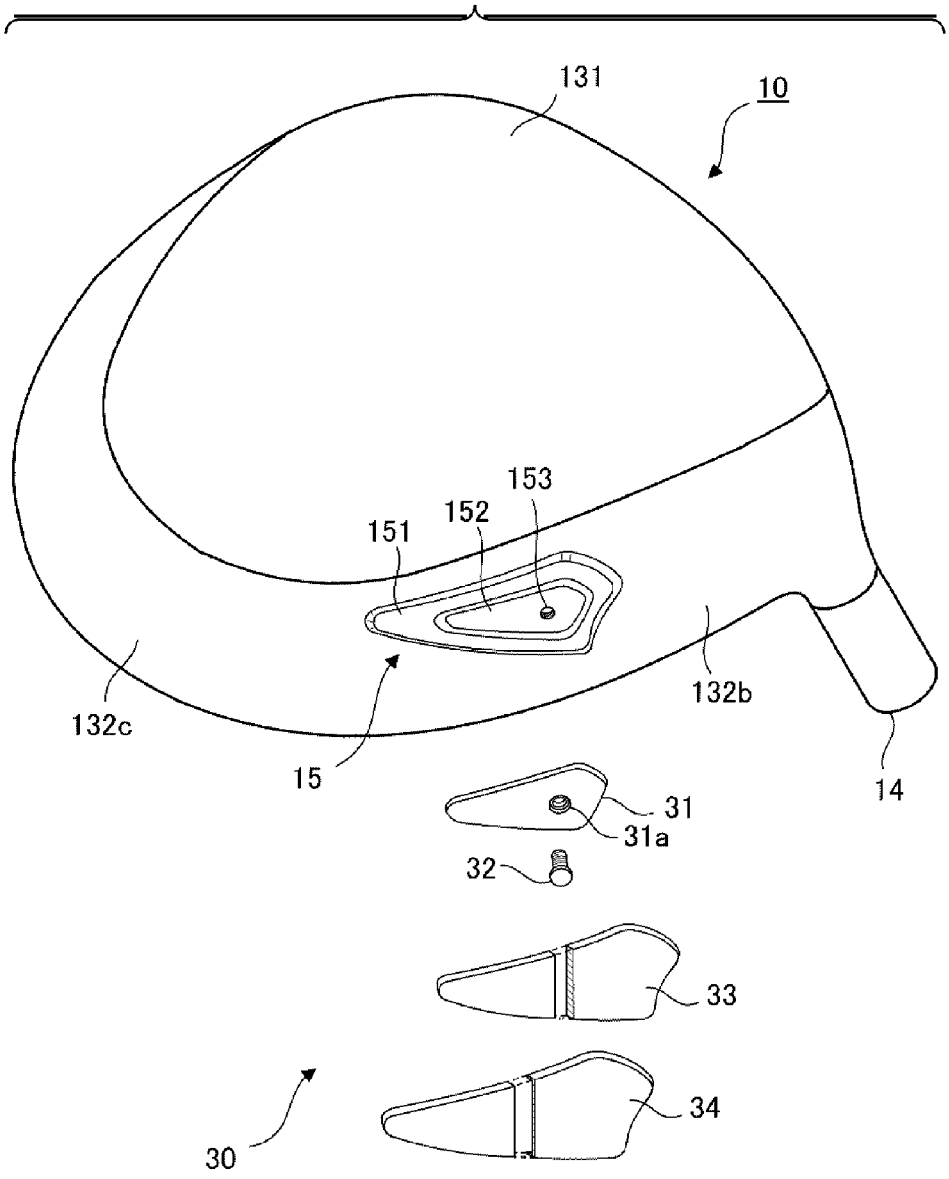
FIG. 3 is an exploded perspective view of the golf club head shown in FIG. 1.

A weight member 30 is disposed on the golf club head 10, as shown in FIG. 2B. The weight member 30 will be described below with reference to FIGS. 2B *and* 3. FIG. 3 is an exploded perspective view of the golf club head 10 and, more specifically, an exploded perspective view of the weight member 30.

Although the weight member 30 can be disposed in an arbitrary portion in accordance with the purpose of use, it is disposed in the sole/side portion 13, more specifically, the heel-side side portion 132*b* in this embodiment. As the volume of the golf club head 10 increases, the barycentric position of the golf club head 10 shifts to the toe side. When the barycentric position is on the toe side, the playability (mainly the face rotation) of the golf club head 10 may degrade. The barycentric position can be adjusted to shift to the heel side by providing the weight member 30 in the heel-side side portion 132*b*.

In this embodiment, the weight member 30 is formed by a principal weight material 31, screw 32, resin material 33, and cover member 34. FIG. 3 is a partially cutaway view of the resin material 33 and cover member 34.

The principal weight material 31 has a through hole 31*a*. The through hole 31*a* is a two-step hole formed by a hole which receives the threaded portion of the screw 32, and a large-diameter hole which receives the head of the screw 32. By inserting the screw 32 into the through hole 31*a* to make the screw 32 threadably engage with an attachment hole 153, the principal weight material 31 can be fixed to the golf club head 10. The attachment hole 153 is a screw hole used to attach the weight member 30.

The principal weight material 31 can be made of, for example, a metal material. The principal weight material 31 may also be formed by mixing a metal powder or metal piece in an elastic body. Examples of the elastic body are a synthetic resin material and a natural resin material (for example, natural rubber). Examples of the metal powder or metal piece mixed in the elastic body are tungsten and a damping metal. Examples of the damping metal are flake graphite cast iron, a magnesium alloy, Silentalloy (Fe—Cr—Al), an Ni—Ti alloy, and an Mn—Cu alloy.

In this embodiment, the resin material 33 has a solid-core plate shape, and is formed by, for example, a synthetic resin material or a natural resin material (for example, natural rubber). The resin material 33 is preferably made of an elastic body (especially a viscoelastic body), and is, for example, NBR (acrylonitrile butadiene rubber) or IIR (butyl rubber).

In this embodiment, the cover member 34 has a shell shape which covers the resin material 33, and is formed by, for example, a metal material such as an aluminum alloy. The cover member 34 is provided mainly to improve the aesthetic design features, and protect the resin material 33.

A recessed portion 15 having an outer surface to which the weight member 30 is attached is formed in the side portion 132*b*. The outer surface means the surface, on the outer side, of a wall body which forms the side portion 132*b*. The surface on the inner side (the surface of the head 10, which faces the internal space) will be referred to as the inner surface hereinafter.

The recessed portion 15 includes a first recessed portion 151, and a second recessed portion 152 receding from the bottom surface defining the first recessed portion 151. The attachment hole 153 extends through the second recessed portion 152. Of the weight member 30, the principal weight material 31 is attached to the second recessed portion 152, and fastened by the screw 32. The resin material 33 is fixed to the first recessed portion 151 by, for example, an adhesive so as to cover the principal weight material 31. The cover member 34 is fixed to the resin material 33 by, for example, an adhesive. With this arrangement, the weight member 30 is fixed to the golf club head 10.

The ribs 20 and 21 and weight portion 22 will be described next with reference to FIGS. 1, 2A, and 2B. The plate-like ribs 20 and 21 which adjust the natural frequency of the golf club head 10, and the point-like weight portion 22 which increases the amplitude of vibration of the sole portion 131 at the time of impact are formed on the inner surface (inner upper surface) of the sole portion 131.

In this embodiment, the rib 20 traverses the sole portion 131 in the toe-to-heel direction, and has its one end connected to the toe-side side portion 132*a*, and its other end connected to the heel-side side portion 132*b*. Although the rib 20 is formed integrally with the sole portion 131 and side portions 132*a* and 132*b* in this embodiment, it may be provided as a separate member and firmly fixed to the sole portion 131 and side portions 132*a* and 132*b*.

Also, although the rib 20 is connected to the side portions 132*a* and 132*b* in this embodiment, it may extend to the upper side and be connected to the crown portion 12. With this arrangement, the constraint effect of the sole portion 131 improves. Also, in this case, the rib 20 and the side portions 132*a* and 132*b* may or may not be connected to each other.

The rib 20 has a height RH and a width RW, as shown in FIG. 2A. The height RH is that from the upper surface of the sole portion 131. In this embodiment, the height RH and the width RW have a relation: Height RH>Width RW. If the cross-sectional area of the rib 20 remains the same throughout its length, the constraint effect of the sole portion 131 is better when Height RH>Width RW, as in this embodiment, than when Height RH<Width RW. The height RH is, for example, 3 mm (inclusive) to 7 mm (inclusive), and the width RW is 1 mm (inclusive) to 2 mm (inclusive).

In general, as the head volume increases, the thickness of the peripheral wall of the head needs to be reduced, and the area of each portion increases along with this trend, so the eigenvalue of the entire head decreases, and the eigenvalue (natural frequency) of the first-order vibration mode of the sole portion 131 also decreases. Therefore, a low-pitched impact sound is more likely to be generated at the time of striking a golf ball in that case. In this embodiment, the sole portion 131 is constrained by providing the rib 20, so the eigenvalue of its first-order vibration mode increases. This makes it possible to increase the pitch of an impact sound.

Figure 4:
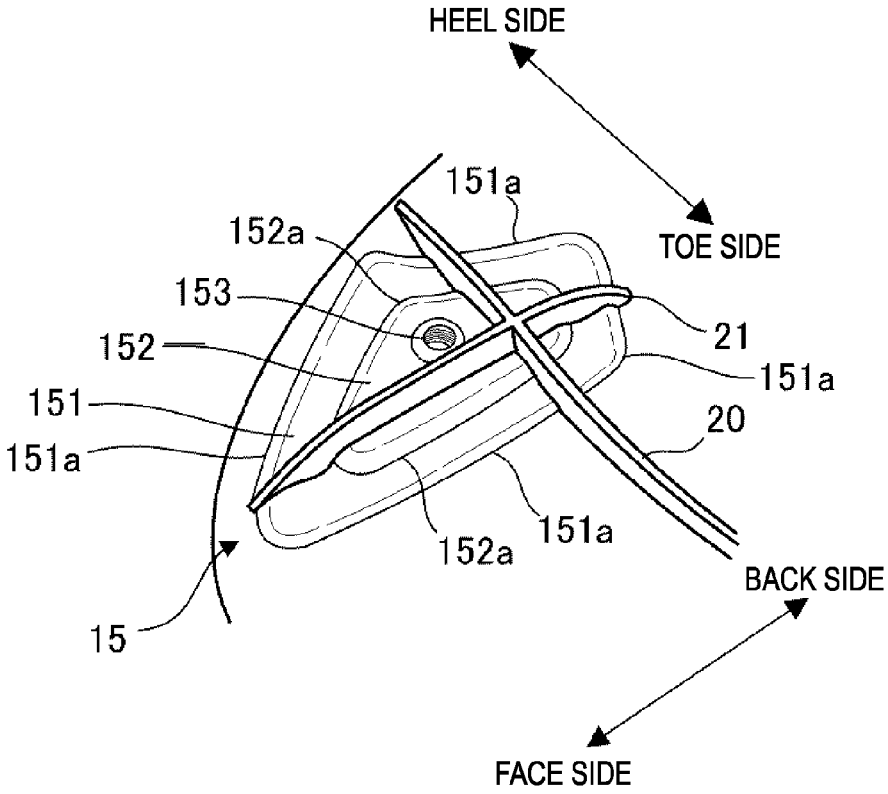
FIG. 4 is a view for explaining a rib.

On the periphery of the weight member 30, the eigenvalue often decreases due to the presence of the weight member 30, resulting in a decrease in pitch of an impact sound. To solve this problem, in this embodiment, the recessed portion 15 is constrained by the ribs 20 and 21. FIG. 4 is a view for explaining the rib 21, and the edge of the rib 20, and shows the periphery of the recessed portion 15 on the inner side of the heel-side side portion 132*b*.

The rib 20 partially traverses the recessed portion 15. Also, the rib 21 is provided especially to constrain the recessed portion 15. The height, width, or forming method of the rib 21 can be the same as in the rib 20.

The rib 20 has an edge that traverses the recessed portion 15, more specifically, traverses the recessed portion 15 across a peripheral edge 151*a* defining the first recessed portion 151, and a peripheral edge 152*a* defining the second recessed portion 152. This makes it possible to improve the constraint effect of the recessed portion 15 on the periphery of the recessed portion 15.

The rib 21 also traverses the recessed portion 15, more specifically, traverses the recessed portion 15 across the peripheral edge 151*a* defining the first recessed portion 151, and the peripheral edge 152*a* defining the second recessed portion 152. This makes it possible to improve the constraint effect of the recessed portion 15 on the periphery of the recessed portion 15. Unlike the rib 20, the rib 21 extends in the back-to-face direction. It is therefore possible to more reliably suppress vibration using both the ribs 20 and 21.

Both the ribs 20 and 21 are extended so as not to pass through the attachment hole 153, and continuously formed without disconnection by the attachment hole 153. This makes it possible to improve the constraint effect of the recessed portion 15. Also, the ribs 20 and 21 intersect with each other at a position where the attachment hole 153 is absent. As the intersection point is located on the recessed portion 15, it is possible to further improve the constraint effect of the recessed portion 15.

Although the ribs 20 and 21 are provided to constrain the recessed portion 15 in this embodiment, only the rib 21 may be disposed on the recessed portion 15, or vice versa. In either case, a predetermined effect of constraining the recessed portion 15 can be obtained.

Also, although the ribs 20 and 21 traverse the first recessed portion 151 and second recessed portion 152 across the peripheral edge 151*a* defining the first recessed portion 151, and the peripheral edge 152*a* defining the second recessed portion 152 in this embodiment, they may traverse only the second recessed portion 152 across the peripheral edge 152*a* defining the second recessed portion 152. The principal weight material 31 is fixed to the second recessed portion 152, on which a heaviest load is imposed, so a predetermined effect of constraining the second recessed portion 152 can be obtained.

The weight portion 22 will be described next with reference to FIGS. 1, 2A, and 2B. The weight portion 22 increases the amplitude of vibration on its periphery. Hence, the weight portion 22 has a weight of, for example, 1 g (inclusive) to 3 g (inclusive). Although the weight portion 22 has a cylindrical shape, it may have another shape. Although the weight portion 22 is formed integrally with the sole portion 131 by locally increasing the thickness of the sole portion 131 in this embodiment, it may be provided as a separate member and attached to the sole portion 131. When the weight portion 22 is provided as a separate member, it preferably uses a member (for example, a screw) having a specific gravity higher than that of a material which forms the sole portion 131. Again, when the weight portion 22 is provided as a separate member, it may be removable from the sole portion 131 so as to be replaced with another weight portion 22 having a different weight. With this arrangement, the user can adjust an impact sound.

Although the weight portion 22 is positioned on the side of the face portion 11 with respect to the rib 20 in this embodiment, it may be disposed on the back side. Nevertheless, it is easier to increase the eigenvalue (natural frequency) of the first-order vibration mode of the sole portion 131 when the rib 20 is positioned closer to the face portion 11.

The weight portion 22 is preferably disposed at the position of an antinode of vibration of the sole portion 131 to increase the amplitude of vibration of the sole portion 131. The position of an antinode of the first-order vibration mode of the sole portion 131 can be obtained by modal analysis using a computer, or eigenvalue analysis using the FEM.

As the degree of constraint of the sole portion 131 is increased using the rib 20, an impact sound can have a higher pitch but still has low loudness and poor resonance. However, in this embodiment, because the weight portion 22 is provided, the amplitude of vibration of the sole portion 131 at the time of impact increases. Therefore, a higher-pitched, louder impact sound can be generated even when the head volume increases. The head volume is, for example, 400 cc (inclusive) to 460 cc (inclusive).

Example

Figure 5:
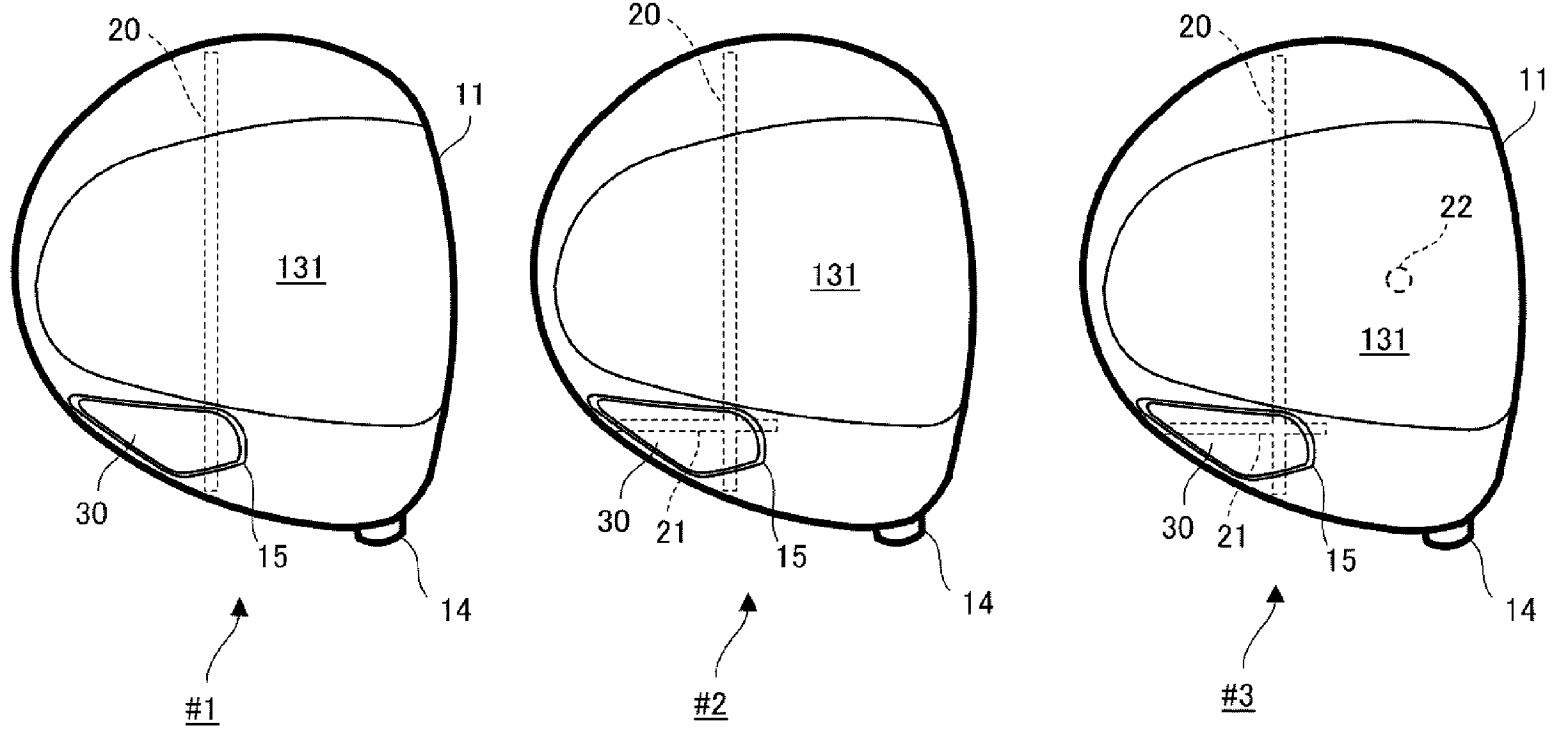
FIG. 5 shows views for explaining golf club heads #1 to #3.

Models of three golf club heads were designed on a computer, and vibration analysis was performed for each model on the computer. FIG. 5 shows views for explaining golf club heads #1 to #3 as viewed from the sides of the sole portions. The same reference numerals denote constituent components equivalent to those in the above-mentioned embodiment.

All of golf club heads #1 to #3 are driver heads with the same shape and the same volume of 460 cc, and are made of a titanium alloy (Ti-6Al-4V). Golf club heads #1 to #3 are different in the presence/absence of a rib 21 and a weight portion 22 (1 g). Golf club head #3 includes both a rib 21 and weight portion 22, and therefore has the same arrangement as the golf club head 10 in the above-mentioned embodiment. Golf club head #2 includes only a rib 21 without a weight portion 22. Golf club head #1 includes neither a rib 21 nor a weight portion 22.

In the analysis, the pitches of impact sounds (the frequencies of the first-order vibration mode) when a weight member 30 is present and when it is absent were calculated. Also, the resonance (vibration time) and the loudness (amplitude) when a weight member 30 is present were calculated. The calculation result of the first-order vibration mode is as follows. Note that Change Ratio=(1−(With Weight Member)/(Without Weight Member))×100(%), and indicates the degree of change in frequency of the first-order vibration mode, which depends on the presence/absence of a weight member 30.

Golf Club Head #1
Without Weight Member: 3,450 Hz
With Weight Member: 3,263 Hz
Change Ratio: 5.7%
Golf Club Head #2
Without Weight Member: 3,291 Hz
With Weight Member: 3,280 Hz
Change Ratio: 0.3%
Golf Club Head #3
Without Weight Member: 3,319 Hz
With Weight Member: 3,228 Hz
Change Ratio: 2.8%

In all of these cases, the change ratio is relatively low, and this means that a given constraint effect of a recessed portion 15 was obtained. In golf club head #1, the change ratio was highest. This is presumably because no rib 21 is present. That is, the rib 21 has a predetermined effect of constraining the recessed portion 15. In golf club head #3, best results were obtained for the resonance (vibration time) and the loudness (amplitude). This is presumably because a weight portion 22 is present.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-128347, filed Jun. 5, 2012, which is hereby incorporated by reference herein in its entirety.

What is claimed is:

1. A hollow golf club head including a face portion, a crown portion, a sole/side portion which includes a sole portion and a side portion, and a weight member, the head comprising:

a recessed portion which is formed in the sole/side portion, and has an outer surface to which the weight member is attached;

a first rib which is formed on an inner surface of the sole/side portion, and traverses said recessed portion across a peripheral edge defining said recessed portion; and a second rib which is formed on the inner surface of the sole/side portion, and intersects with said first rib at a position in said recessed portion, wherein said first and second ribs protrude from said recessed portion.

2. The head according to claim 1, wherein said first rib extends from a toe side to a heel side.

3. The head according to claim 2, wherein said recessed portion is formed in the side portion on the heel side, and said first rib is connected to the side portion on the heel side, and the side portion on the toe side upon traversing the sole portion.

4. The head according to claim 1, wherein said recessed portion includes an attachment hole used to attach the weight member, and said first rib extends so as not to pass through said attachment hole.

5. The head according to claim 4, further comprising:

a second rib formed on the inner surface of the sole/side portion, wherein said attachment hole is absent at the position.

6. The head according to claim 1, wherein the weight member includes a damping metal.

7. The head according to claim 1, wherein the sole portion includes a weight portion which increases an amplitude of vibration of the sole portion, and said weight portion has a weight of 1 g (inclusive) to 3 g (inclusive).

8. The head according to claim 7, wherein said weight portion is disposed at a position of an antinode of a first-order vibration mode of the sole portion.

9. The head according to claim 1, wherein said first rib has a height of 3 mm (inclusive) to 7 mm (inclusive), and a width of 1 mm (inclusive) to 2 mm (inclusive).

10. The head according to claim 1, wherein said second rib traverses said recessed portion across the peripheral edge defining said recessed portion.

* * * * *